United States Patent [19]

Schlesinger et al.

[11] Patent Number: 4,514,354

[45] Date of Patent: Apr. 30, 1985

[54] MANUFACTURE OF MOLDED PAPERBOARD ARTICLES

[75] Inventors: Sheldon I. Schlesinger, East Windsor, N.J.; Walter S. Cerenzia, Morrisville, Pa.; Thomas D. Wilson, Hamilton Square, N.J.

[73] Assignee: James River-Norwalk, Inc., Norwalk, Conn.

[21] Appl. No.: 448,647

[22] Filed: Dec. 10, 1982

[51] Int. Cl.[3] ..... B29G 5/00

[52] U.S. Cl. ..... 264/324; 264/322; 264/325; 264/DIG. 66

[58] Field of Search ..... 264/322, 324, 325, DIG. 66, 264/123, 124; 162/382, 383

[56] References Cited

U.S. PATENT DOCUMENTS

| | | | |
|---|---|---|---|
| 1,506,515 | 8/1924 | Cormie | 162/383 |
| 1,848,055 | 1/1932 | Chaplin | 162/382 |
| 2,014,297 | 9/1935 | Rutledge | 229/2.5 |
| 2,079,667 | 5/1937 | Swift, Jr. | 162/383 |
| 2,103,318 | 12/1937 | Clapp | 264/324 |
| 2,338,685 | 1/1944 | Dee | 264/322 |
| 2,348,272 | 5/1944 | Wiley | 264/324 |
| 3,305,434 | 2/1967 | Bernier | 425/397 |
| 3,557,277 | 1/1971 | Brodersen | 264/322 |
| 3,758,357 | 9/1973 | Akerson | 264/324 |
| 4,026,458 | 5/1977 | Morris | 229/2.5 R |

*Primary Examiner*—Jay H. Woo
*Assistant Examiner*—Mike McGurk
*Attorney, Agent, or Firm*—William A. Aguele; Harry W. Hargis, III; Thomas H. Whaley

[57] ABSTRACT

A method of forming pressed paperboard and pressed paperboard articles from a cellulosic fiber pulp, wherein the paperboard or paperboard articles has improved high temperature properties required of ovenable cookware. A preformed sheet or blank formed from a cellulosic fiber pulp, and having a water content in a range of from about 50% to about 100% by weight, is placed in an unheated press or mold to form the sheet or blank at a pressure in the range of from about 160 psi to about 2600 psi and then dried. When compared with hot press dried paperboard or shaped paperboard articles, such as ovenable baking trays, the products of the method of this invention have superior burst strengths after exposure to a temperature of 450° F. (232° C.) for one hour.

5 Claims, 2 Drawing Figures

MANUFACTURE OF MOLDED PAPERBOARD ARTICLES

This invention relates to the manufacture of pressed paperboard. In one of its more specific aspects, this invention relates to a method for forming molded paperboard articles, e.g. trays, capable of withstanding the relatively high temperatures encountered in baking bread and other foods in ovens for extended period of time.

Trays of the type to which this invention relates are known in the art generally as high temperature ovenable cookware. The trays are formed by a so-called pressed paperboard process, wherein a suitable paperboard blank is placed between a pair of matched forming dies which are then moved to their closed position and subjected to pressure to form the blank into the desired shape, e.g. a tray.

In accordance with conventional practice for forming a molded paperboard article, cellulosic fibers are formed into a paperboard sheet from which blanks are cut and inserted between a pair of forming dies which stamp it into the desired shape. The blanks usually contain about 6 to 8 percent moisture absorbed from the atmosphere. Higher moisture contents in the range of 15% to 35% by weight, based on the weight of the finished stock, have been disclosed, for example, in U.S. Pat. No. 3,305,434, incorporated herein by reference. The dies are provided with heating devices to heat and press-dry the paperboard stock during forming operations. U.S. Pat. Nos. 3,305,434; 2,014,297; and 4,026,458 are illustrative of the prior art.

Press-drying of moist pulp sheets at elevated temperatures in excess of 120° C. (hot-press drying) and at pressures as high as 10,000 psi is known in the prior art as a means for improving the burst strength, tensile properties, and other physical properties of paper or paperboard.

The present invention is based on the discovery that improved high temperature performance of paperboard articles, e.g. trays, is achieved if the article is formed of wet paperboard, i.e. paperboard having a moisture content within the range of 50 to 100 percent, and preferably 65 to 85 percent by weight, based on the dry weight of the fiber, while maintaining the mold elements at or near ambient temperature, i.e. with no application of heat. This invention provides a method for forming an ovenable paperboard tray of improved rigidity and strength from wet paperboard without partial or complete drying and without hot pressing.

In accordance with the method of this invention, wet paperboard formed from a pulp of cellulosic fibers and having a water content in a range of from about 50 to about 100%, preferably in the range of 65% to about 85% by weight, based on the dry weight of the fiber is pressed between an unheated set of matching dies at a pressure in a range of from about 160 psi to about 2600 psi, suitably in the range of 600 to 1200 psi, to produce a molded article, such as a baking dish or tray, having superior strength when subjected to baking temperatures of the order of 400° F. (204° C.).

Figure 1:
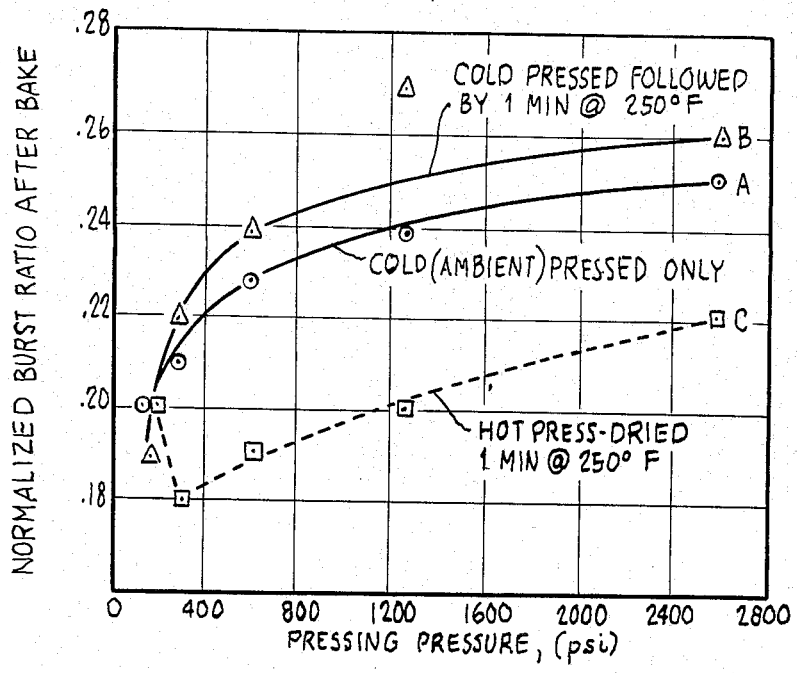
Figure 2:
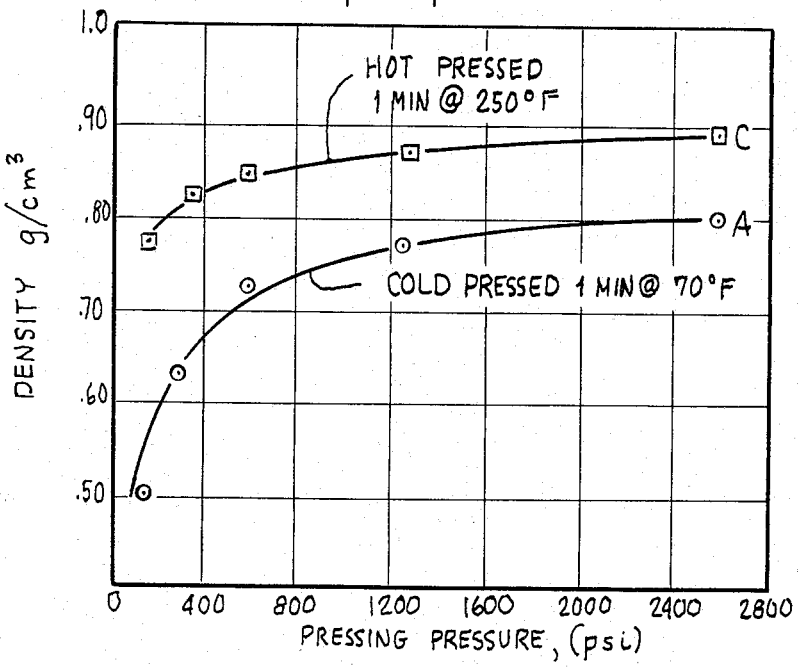

The method of this invention may be more fully understood from a consideration of the following description and accompanying figures wherein FIG. 1 is a graphic representation of the relationship between pressing pressure and Mullen burst strengths of various paperboards after baking for 1 hour, illustrating the improved properties of paperboards made by the method of this invention; and FIG. 2 is a graphic representation of the relationship between pressing pressure and paperboard density of hot pressed and cold pressed paperboard products.

In the preferred method of the present invention, wet paperboard is cold pressed, preferably at ambient temperature, to the desired finished shape and then dried at a relatively moderate temperature producing pressed board products having improved physical properties on exposure to elevated temperatures.

In another embodiment of the method of this invention, wet paperboard is cold pressed to form a paperboard blank followed by drying of the blank and then pressing or forming the paperboard blank into the finished molded product. In this embodiment, the preconditioned paperboard, after cold pressing and drying and with a moisture content in the range of about 8 to 10 percent, is pressed at a press pressure in the range of about 100 to 400 psi at a temperature in the range of 200° to 300° F.

Although cold pressing wet paperboard physically removes some of the water from the paperboard, the pressed product still has a high moisture content after pressing in the range of 35 to 55 weight percent water. The product may be dried either at ambient temperature or moderate temperature, e.g. 20° C. to 120° C.

The effectiveness of the cold press method of this invention as compared with conventional hot press methods was determined by measurement of the Mullen burst strength of the paperboard produced by both methods after 1 hour exposure to a temperature of 450° F. (232° C.) in a forced air, electrically heated oven. For the intended principal application of this invention, ovenable paperboard cooking vessels must have a minimum burst strength of 60 pounds per square inch (psi), herein termed "baked burst strength", after 1 hour exposure in an oven at 232° C., herein "oven baking test".

We have discovered that the thermal resistance of pressed paperboard products is unexpectedly increased when the pressing of wet paperboard having a water content in the range of 50 to 100 weight percent, based on the weight of the dry fiber, is carried out at ambient temperature with no heating of the press platens. This results in a moist paperboard product which may be dried either under ambient conditions or in a subsequent heatdrying step. That the discovery was not obvious is shown by a comparison of Mullen burst strengths and "normalized burst values" before and after the oven baking test for hot-press dried vs. cold-wet-pressed unbleached kraft (UBK) paperboards as shown in Tables I and II of the following examples. The "normalized burst" values used herein were derived by dividing each of the Mullen burst test values in pounds per square inch by the basis weight in grams per square meter ($g/m^2$) for each specimen tested. Although the unbaked burst strengths of hot-pressed paperboards were generally higher than those of cold pressed paperboard at the lower pressing pressures, the burst strengths of the products after baking were higher for cold-pressed paperboards.

EXAMPLE I

Paper handsheets were formed in a TAPPI sheet mold with 33.65 g (calculated for 350 $g/m^2$ basis weight of completed sheet) portions of "never-dried" unbleached kraft (UBK) softwood pulp containing 79.2% water by weight and 20.8% solids as received. Before forming the sheet, each pulp sample was disintegrated for 75,000 revolutions (3000 count) in the standard TAPPI-British disintegrator. The resulting 6.25 inch diameter paper circle was couchrolled between successive blotters until a wet weight was achieved, indicating a moisture content of 65–67% (initial moisture content). As an aid in reducing the moisture content to the desired level, each sheet was also pressed at 3.45 bar (50 psi) in the TAPPI press between blotters.

Triplicate sets of the resulting wet handsheets were then pressed between the jaws of a hydraulic platen press for 1 minute each, with press settings to achieve actual pressures of from about 11 to 179 bar (160 to about 2600 psi) based upon a handsheet surface area of 197.87 $cm^2$ (30.67 square inches). For each pressing pressure, two sheets were cold pressed and one hot pressed. In preparing the hot pressed specimen sheets employed in the comparative tests, the wet pulp sheet was sandwiched between two stainless steel screens having 24 meshes per lineal centimeter (60 mesher per lineal inch), which in turn were placed between two stainless steel press plates before insertion between the press-jaws which were preheated at 121° C. For the cold press specimens, a blotter paper was placed between the screen and press plate on top and bottom, in order to absorb water squeezed out during the pressing between unheated platens. In these comparative tests, pressing times were all of 1 minute duration.

The cold-pressed paper had moisture contents ranging from 55 to 37% over the 11 to 179 bar pressing pressure range. The hot-pressed paper had a 15% moisture content at 11 bar and a range of from 3.7 to 2.1% thereafter up to 179 bar. One specimen of each set of the cold-pressed paperboards was heated for 1 minute at 121° C. after the cold-pressing in order to remove part of the water. Moisture contents of the specimens subjected to this subsequent heating step were in the range of 18% to 3.6% as indicated in Table I.

All paperboard specimens were conditioned at 50% relative humidity and 23° C. (73° F.) for 48 hours prior to their evaluation. After conditioning in this manner, all paperboard specimens had moisture contents of about 6.3% by weight.

The strength of paperboard and its resistance to thermal degradation may be measured by the standard Mullen burst test which is fully described in TAPPI Method T8105SU-66, incorporated herein by reference. Briefly, the Mullen test involves clamping a flat, thin sample between two rings having a 1 inch (2.54 cm) diameter hole in their centers carefully aligned relative to one another. The clamped sample is then mechanically held while a rubber bladder is inflated against the sample sheet spanning the opening in the rings. The air pressure in pounds per square inch gauge (psig) necessary to force the bladder through the sample is recorded as the "burst".

Each of the cold pressed specimens were heated for one hour at 232° C. (450° F.) in a forced air oven and then subjected to the Mullen burst test to determine the strength of the specimens after this heat treatment. After the baking test, the paperboards were conditioned for 24 hours before measuring burst and other physical properties. Complete data for these tests are shown in Tables I and II.

The test results are illustrated graphically in curves A and B of FIG. 1. It will be observed that drying the paperboard for one minute at 121° C. (250° F.) improved the burst strength of the subsequently heated specimens. Comparison of curves A and B with curve C illustrates the improvements in burst strength which results from cold pressing as compared with hot pressing of paperboards. As illustrated in FIG. 1, curve A represents the results obtained by cold (ambient temperature) pressing only; curve B, by cold pressing followed by heating 1 minute at 121° C. (250° F.) outside the press; and curve C, by not pressing at 121° C. for 1 minute.

To account for small variations in basis weights, a "normalized burst ratio" is employed in plotting the curves shown in FIG. 1. The normalized burst ratio, as used herein, is the Mullen burst strength in pounds per square inch gauge divided by the basis weight in grams per square meter.

TABLE I

| | | | | COLD PRESSED PAPERBOARD | | | | | | |
|---|---|---|---|---|---|---|---|---|---|---|
| | | | | | BASIS WEIGHT | | BURST STRENGTH (1) | | | |
| Run No. | Initial % $H_2O$ | Press Pressure (psi) | % $H_2O$ After Press | % $H_2O$ After 1 min. @ 250° F. | $g/m^2$ | lb/ream | Unbaked | Baked | BURST RATIO (2) | Density (3) ($g/cm^3$) |
| 1 | 66.1 | 163 | 55.1 | Unheated | 327 | 202 | 132 | 64 | 0.20 | 0.50 |
| 2 | 66.7 | 163 | 55.1 | 18 | 331 | 204 | 150 | 64 | 0.19 | .54 |
| 3 | 65.8 | 325 | 48.2 | Unheated | 331 | 204 | 180 | 71 | 0.21 | .62 |
| 4 | 66.4 | 325 | 49.2 | 4.7 | 326 | 201 | 195 | 71 | 0.22 | .53 |
| 5 | 66.2 | 650 | 43.5 | Unheated | 321 | 198 | 204 | 75 | 0.23 | .72 |
| 6 | 66.7 | 650 | 39.7 | 4.4 | 327 | 202 | 192 | 77 | 0.24 | .71 |
| 7 | 65.8 | 1300 | 40.4 | Unheated | 335 | 207 | 225 | 79 | 0.23 | .77 |
| 8 | 66.5 | 1300 | 40.5 | 4 | 329 | 203 | 220 | 87 | 0.26 | .77 |
| 9 | 65.5 | 2600 | 36.7 | Unheated | 324 | 200 | 242 | 79 | 0.24 | .79 |
| 10 | 66.1 | 2600 | 37.4 | 3.6 | 327 | 202 | 207 | 85 | 0.26 | .76 |

(1) Mullen burst test (psig)
(2) Burst strength (psig) divided by basis weight ($g/m^2$)
(3) Density of dried unbaked paperboard in grams per cubic centimeter

TABLE II

| | | | | HOT PRESSED PAPERBOARD | | | | | |
|---|---|---|---|---|---|---|---|---|---|
| | | | | BASIS WEIGHT | | BURST STRENGTH, (1) | | | |
| Run No. | Initial % $H_2O$ | Press Pressure psi | % $H_2O$ After Press | $g/m^2$ | lb/ream | Unbaked | Baked | BURST RATIO Baked (2) | Density (3) ($g/cm^3$) |
| 11 | 66.1 | 163 | 15.3 | 337 | 208 | 207 | 67.7 | 0.20 | 0.77 |
| 12 | 67.3 | 325 | 3.7 | 341 | 210 | 207 | 60.7 | 0.18 | .84 |
| 13 | 66.7 | 650 | 2.6 | 334 | 206 | 214 | 62.7 | 0.19 | .85 |

TABLE II-continued

| Run No. | Initial % $H_2O$ | Press Pressure psi | % $H_2O$ After Press | HOT PRESSED PAPERBOARD BASIS WEIGHT g/m² | lb/ream | BURST STRENGTH, (1) Unbaked | Baked | BURST RATIO Baked (2) | Density (3) (g/cm³) |
|---|---|---|---|---|---|---|---|---|---|
| 14 | 67.6 | 1300 | 2.1 | 335 | 207 | 198 | 68.0 | 0.20 | .86 |
| 15 | 66.8 | 2600 | 2.6 | 333 | 205 | 156 | 72.0 | 0.22 | .88 |

(1) Mullen burst test pressure (psig)
(2) Burst strength (psig) divided by basis weight (g/m²)
(3) Density of dried unbaked paperboard in grams per cubic centimeter

EXAMPLE II

Paperboards with 66 weight percent initial moisture content, prepared as in Example I, were cold-pressed at 27.6 bar (400 psi) with variations in press time from 60 seconds to 1 second. These paperboards were subjected to heating in a forced air oven at 121° C. for 1 minute after pressing, and then conditioned at 50% relative humidity and 23° C. (73° F.). The range of baked burst strengths (after heating for 1 hour at 232° C.) of these paperboards as shown in Table III was from about 90 psi for 60 seconds press time to 80 psi for 1 second press time, corresponding to normalized burst ratios of 0.27 to 0.23. These values far exceeded the 0.18 burst ratio obtained at 400 psi for hot-pressed board even at 60 seconds press retention time.

TABLE III

VARIATION OF BAKED BURST WITH PRESS RESIDENCE TIME IN COLD PRESSED PAPERBOARDS
PRESSING PRESSURE 27.6 bar (400 psi)

| Run No. | Pressing Time, Sec. | Basis Weight g/m² | lb/ream | After 1 Hour at 450° F. Burst Strength, psi | Burst Ratio |
|---|---|---|---|---|---|
| 16 | 60 | 345 | 213 | 88 | 0.26 |
| 17 | 30 | 345 | 213 | 93 | .27 |
| 18 | 10 | 350 | 216 | 90 | .26 |
| 19 | 5 | 350 | 216 | 84 | .24 |
| 20 | 2 | 348 | 215 | 82 | .24 |
| 21 | 1 | 340 | 210 | 81 | .24 |
| 22* | 0 | 348 | 215 | 45 | .13 |

*Unpressed control specimen

Example II illustrates an important advantage of cold-pressing over hot press-drying. With cold press drying the pressing time may be shortened to the minimum needed to compress the paper and force water out. It will be observed from Table III that cold pressing times in the range of 1 to 10 seconds are adequate to produce pressed paperboard and press shaped paperboard articles having a burst ratio exceeding those of comparable hot press dried paperboard and hot press shaped and dried paperboard articles. By definition and practice, the retention time in hot-press drying must be long enough, usually in the range of 30 seconds to 1 minute to evaporate off the water. The escape of water is counteracted to some extent by the pressure of the press platens in press drying.

EXAMPLE III

A handsheet formed as described in Example I was cold-pressed at 325 psi pressing pressure, and conditioned at 50% relative humidity and 23° C. The resulting handsheet with 6.3% moisture content and 305 g/m² (188 lb./ream) basis weight was then conditioned at 66% relative humidity, to a final moisture content of 8.1%.

The sample was finally scored and pressed into a 1 inch deep pie plate with 18° sidewall angle, using 260° F. (127° C.) die temperature, 130 psi pressure, and 2 sec. dwell time. After 1 hour at 232° C., the plate bottom had a burst strength of 64 psi.

From the foregoing description it will be appreciated that the method of this invention is capable of producing pressed paperboard and press shaped paperboard articles, such as ovenable trays, with remarkably improved burst strength retention as compared with similar products produced by conventional methods of the prior art when exposed to a temperature of 232° C. (450° F.) for one hour.

It will be further appreciated that the method of the invention is capable of producing an improved paperboard having the property of imparting improved thermal resistance to products subsequently produced by pressing the paperboard into ovenware. Alternatively, the method may be employed for press molding directly into the final shape. In the latter instance, final drying of the product may be carried out either at ambient temperature or moderately elevated temperatures, preferably with suitable restraint to prevent distortion of the molded product during the drying operation.

We claim:

1. A method of forming an ovenable paperboard container from paperboard sheet by press forming between a pair of forming dies, said container having improved burst strength after exposure to a temperature of 450° F. for one hour as compared with that of hot pressed paperboard of the same base stock, which comprises adjusting the moisture content of sheet paperboard base stock consisting of cellulosic fiber pulp to a water content within the range of from about 50% to about 100% by weight based on the dry weight of fiber; pressing said paperboard stock in the absence of externally applied heat into a shaped paperboard container at a pressure in a range from about 325 psi to about 2600 psi; and drying the pressed shaped container.

2. The method of claim 1 wherein said pressed paperboard container is dried at a temperature of about 250° F.

3. The method of claim 1 wherein said fibers comprise unbleached kraft softwood.

4. The method of claim 1 wherein said container is molded at a pressure in the range of from about 500 to about 1500 psi from paperboard stock having a water content in the range of about 65 to 85% by weight based on the dry weight of the fiber.

5. The method of claim 1 wherein the pressing time is within the range of 1 to 10 seconds.

* * * * *